US007576701B2

(12) United States Patent
McGrath et al.

(10) Patent No.: US 7,576,701 B2
(45) Date of Patent: Aug. 18, 2009

(54) ROTATING SCREEN DUAL REFLECTOR ANTENNA

(75) Inventors: Daniel T. McGrath, McKinney, TX (US); Kuang-Yu Wu, Plano, TX (US); Matthew Fassett, Tucson, AZ (US); James C. McRae, Frisco, TX (US)

(73) Assignee: Raytheon Company, Waltham, MA (US)

( * ) Notice: Subject to any disclaimer, the term of this patent is extended or adjusted under 35 U.S.C. 154(b) by 168 days.

(21) Appl. No.: 11/695,112

(22) Filed: Apr. 2, 2007

(65) Prior Publication Data

US 2008/0238790 A1 Oct. 2, 2008

(51) Int. Cl.
*H01Q 19/06* (2006.01)

(52) U.S. Cl. ..... 343/754; 343/755; 343/757

(58) Field of Classification Search ..... 343/754, 343/755, 761, 756, 757, 781 R, 837
See application file for complete search history.

(56) References Cited

U.S. PATENT DOCUMENTS

| | | | | |
|---|---|---|---|---|
| 2,728,912 A | | 12/1955 | Wells | |
| 3,793,637 A | * | 2/1974 | Meek | 343/761 |
| 3,795,003 A | * | 2/1974 | Meek et al. | 343/754 |
| 3,979,755 A | | 9/1976 | Sandoz et al. | 343/754 |
| 4,720,170 A | * | 1/1988 | Learn, Jr. | 359/597 |
| 4,864,317 A | * | 9/1989 | Sorko-Ram | 343/720 |
| 4,905,014 A | | 2/1990 | Gonzalez et al. | 343/909 |
| 5,945,946 A | | 8/1999 | Munger | 342/367 |
| 6,404,399 B1 | | 6/2002 | Morita | 343/761 |

FOREIGN PATENT DOCUMENTS

DE 886 163 8/1953

OTHER PUBLICATIONS

Communication from The European Patent Office, Partial European Search Report for Application No. 08006241.7-2220 dated Aug. 5, 2008, 6 pages.

Communication from the European Patent Office, European Search Report dated Oct. 27, 2008—transmitted to Baker Botts LLP on Dec. 19, 2008, for European Patent Application No. 08006241.7-2220 / 1983612, 9 pages.

* cited by examiner

*Primary Examiner*—Tho G Phan
(74) *Attorney, Agent, or Firm*—Baker Botts L.L.P.

(57) ABSTRACT

A system for steering a beam includes a main reflector that receives a signal from a subreflector and reflects the signal in a reflection direction. A prism refracts the signal in a refraction direction. One or more motors adjust a relative orientation between the main reflector and the prism to change a relative orientation between the reflection direction and the refraction direction to steer a beam resulting from the signal.

20 Claims, 3 Drawing Sheets

ROTATING SCREEN DUAL REFLECTOR ANTENNA

GOVERNMENT RIGHTS

This invention was made with Government support under a classified contract awarded by [federal agency withheld]. The Government may have certain rights in this invention.

TECHNICAL FIELD

This invention relates generally to the field of antenna systems and more specifically to a rotating screen dual reflector antenna.

BACKGROUND

Antenna systems use antennas to transmit signals to communicate information. Known antenna systems may use parabolic reflector antennas or slotted waveguide antennas. Some of these known antenna systems, however, encounter difficulties. As an example, an antenna system may require complicated motors to move heavy parts of the antenna along two axes to direct a beam of signals. As another example, the movement may require that parts of the antenna be flexible or bendable. As yet another example, the movement of the parts inside the antenna radome may limit the size of the antenna, which may limit the antenna gain.

SUMMARY OF THE DISCLOSURE

In accordance with the present invention, disadvantages and problems associated with previous techniques for steering a beam of a dual reflector antenna may be reduced or eliminated.

According to one embodiment of the present invention, a system for steering a beam includes a main reflector that receives a signal from a subreflector and reflects the signal in a reflection direction. A prism refracts the signal in a refraction direction. One or more motors adjust a relative orientation between the main reflector and the prism to change a relative orientation between the reflection direction and the refraction direction to steer a beam resulting from the signal.

Certain embodiments of the invention may provide one or more technical advantages. A technical advantage of one embodiment may be that the relative orientation of a prism and main reflector may be changed by rotating them about an axis. Motors used to rotate the prism and main reflector may be simpler and less expensive than motors used to move a parabolic reflector in multiple directions.

Certain embodiments of the invention may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of the present invention and its features and advantages, reference is now made to the following description, taken in conjunction with the accompanying drawings, in which.

DETAILED DESCRIPTION OF THE DRAWINGS

Embodiments of the present invention and its advantages are best understood by referring to FIGS. 1A through 4 of the drawings, like numerals being used for like and corresponding parts of the various drawings.

Figure 1A:
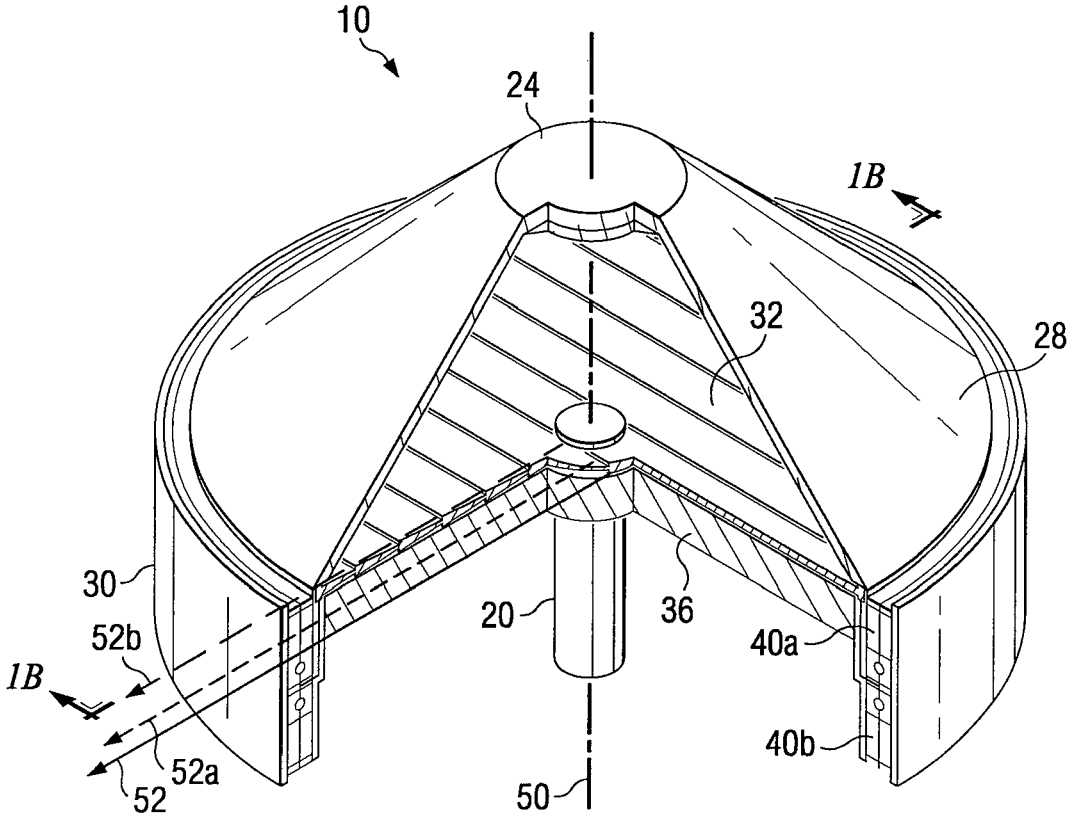
FIGS. 1A and 1B illustrate one embodiment of a system for transmitting and receiving signals.
Figure 1B:
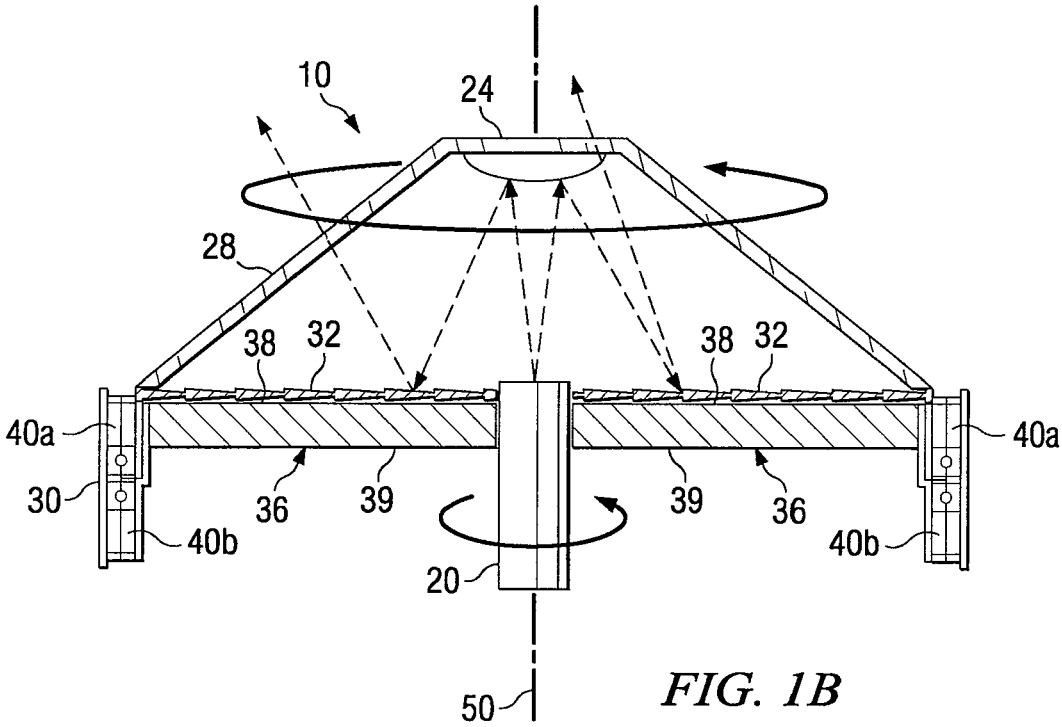

FIGS. 1A and 1B illustrate one embodiment of a system 10 for transmitting signals. FIG. 1A is a cutaway perspective view of system 10, and FIG. 1B is a cross-sectional view of system 10. According to the illustrated embodiment, system 10 includes an antenna feed 20, a subreflector 24, a subreflector support 28, a main support 30, a prism 32, a main reflector 36, and motors 40*a-b* coupled as shown. System 10 may have a boresight axis 50 and a transverse axis 52. Boresight axis 50 may be defined by a line from a substantially central point of antenna feed 20 to a substantially central point of subreflector 24. Transverse axis 52 is perpendicular to boresight axis 50. A main reflector axis 52*a* is defined by the plane of main reflector 36, and a prism axis 52*b* is defined by the plane of prism 32.

In one embodiment of operation, antenna feed 20 directs signals from a signal oscillator towards subreflector 24. Subreflector 24 reflects the signals towards prism 32. Prism 32 refracts the signals in a refraction direction, and main reflector 36 reflects the signals in a reflection direction back through prism 32. The refraction and reflection directions affect the direction of the beam and may be changed to steer the beam. Motors 40*a-b* rotate prism 32 and main reflector 36 to change refraction and reflection directions to the steer the beam.

In the illustrated embodiment, antenna feed 20 may be located substantially about axis 50, and may have any suitable shape or size. Antenna feed 20 may generate a beam with a substantially circular cross-section, with a beam width comparable to the subreflector's angular extent measured from the feed opening. Antenna feed 20 may comprise a compact antenna feed, such as an open waveguide, horn, or small array feed. In one embodiment, antenna feed 50 is not required to move to direct the resulting beam.

Subreflector 24 reflects the signals towards main reflector 36. Subreflector 24 may comprise any suitable material operable to reflect signals, for example, metal or metal-coated material. Subreflector 24 may have any suitable size and shape, for example, a substantially circular shape with a diameter of greater than five wavelengths.

Subreflector support 28 couples subreflector 24 to main support 30, and may support subreflector 24 such that subreflector 24 satisfactorily receives signals from antenna feed 20 and reflects the signals towards main reflector 36. Subreflector support 28 may comprise any suitable material, for example, a low-density, low-loss dielectric or metal. Subreflector support 28 may have any suitable shape, for example, a substantially conical shape with a smaller diameter substantially similar to the diameter of subreflector 24 and a larger diameter substantially similar to the diameter of main support 30. Subreflector support 30 may comprise a shell or struts.

Main support 30 provides support for motors 40*a-b*, feed 20, and/or subreflector support 28. Main support 30 may be used to mount system 10 to a structure such as a building or vehicle.

Prism 32 refracts signals reflected from subreflector 24 and from main reflector 36 in a refraction direction. Prism 32 may have any suitable shape and size, for example, a substantially circular shape with a diameter determined according to the desired antenna beamwidth. An example of prism 32 is described in more detail with reference to FIG. 4.

Main reflector 36 reflects signals refracted by prism 32 back through prism 32. The signals are reflected in a reflection direction that may be different from axis 50. According to one embodiment, main reflector 36 may comprise a substrate 39 having a pattern defined on a surface 38 from which signals are reflected. For example, main reflector 36 may comprise a printed circuit board with a frequency selective surface (FSS). An example of main reflector 36 is described in more detail with reference to FIGS. 2 and 3.

The refraction and reflection directions affect the angle of the beam with respect to axis 50. If the refraction and reflection directions are the same, the beam is directed at a maximum angle, for example, approximately 45 degrees, from axis 50. If the refraction and reflection directions are the opposite, they cancel each other and the beam is directed along axis 50.

The directions θ and ϕ of the beam may be described in spherical coordinates (r,θ,ϕ), where θ represents the angle from axis 50 and ϕ represents the angle from axis 52, by the following equations:

$$\phi = \left(\frac{\alpha+\beta}{2}\right) \pm 90^\circ$$

$$\theta = \sin^{-1}\left[\pm 2\sin\gamma\cos\left(\frac{\alpha-\beta}{2}\right)\right]$$

$$\gamma = \sin^{-1}(.5\sin\theta_{max})$$

where $\theta_{max}$ represents the maximum angle from axis 50, α represents the angle between main reflector axis 52*a* and transverse axis 52, and β represents the angle between prism axis 52*b* and transverse axis 52.

Motors 40 change the positions of prism 32 and main reflector 36 and the relative orientation between prism 32 and main reflector 36 to steer the beam. In one embodiment, one or more motors 40 may rotate prism 32 and/or main reflector 36. A motor 40 may operate at the periphery of the object that it is rotating, which may allow for a compact design of system 10. Any suitable components may be rotated together. For example, subreflector 24 and subreflector support 28 may rotate with either prism 32 or main reflector 36.

Any suitable number or configuration of motors 40 may move prism 32 and/or main reflector 36. According to the illustrated embodiment, a prism motor 40*a* moves prism 32, and a main reflector motor 40*b* moves main reflector 36. A motor 20 may comprise any suitable motor, and motors 40*a-b* may be substantially similar or different. According to one embodiment, motor 40 comprises a direct-drive torque motor.

Modifications, additions, or omissions may be made to system 10 without departing from the scope of the invention. The components of system 10 may be integrated or separated. For example, signal oscillator 18 may be separated from the rest of system 10, but may be coupled to antenna feed 20 via a link. Moreover, the operations of system 10 may be performed by more, fewer, or other components. For example, the operations of motors 40*a-b* may be performed by one component, or the operations of prism 32 may be performed by more than one component. As used in this document, "each" refers to each member of a set or each member of a subset of a set.

System 10 may be used for any suitable application. For example, system 10 may be used for systems that use high gain (narrow beam) antennas, such as certain radar and telecommunications systems.

Figure 2:
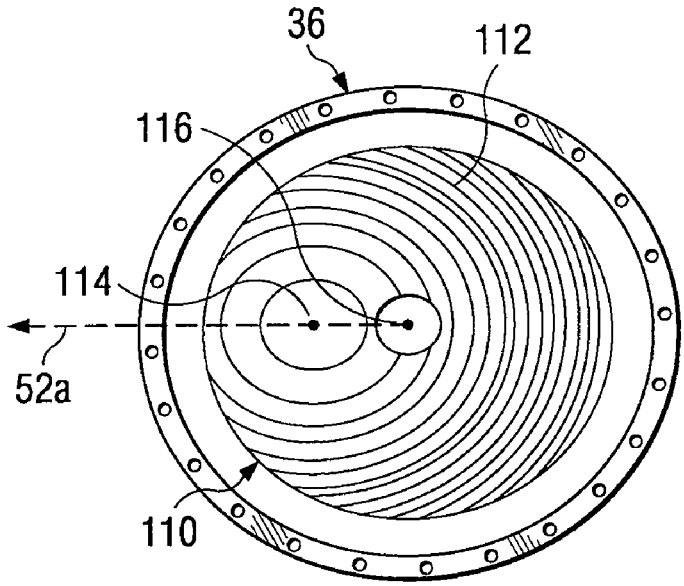
FIG. 2 illustrates an embodiment of a main reflector that may be used with the system of FIG. 1.

FIG. 2 illustrates an embodiment of a main reflector 36 that may be used with system 10 of FIG. 1. Main reflector 36 has a pattern 110 that reflects signals. The variations in the phases of the surface reflection may imitate variations in path delay. For example, parabolic variations in the phase delay may allow the surface to imitate a reflector having a parabolic shape.

Main reflector 36 has an asymmetrical pattern 110 operable to reflect signals in a reflection direction that differs from axis 50. According to the illustrated embodiment, pattern 110 comprises phase zones defined by concentric ellipses 112. The centers 114 of ellipses 112 may be at different points than the center 116 of reflector 36.

Modifications, additions, or omissions may be made to patterns 110 without departing from the scope of the invention. Patterns 110 may include more, fewer, or other elements. Additionally, the elements may be placed in any suitable arrangement.

Figure 3:
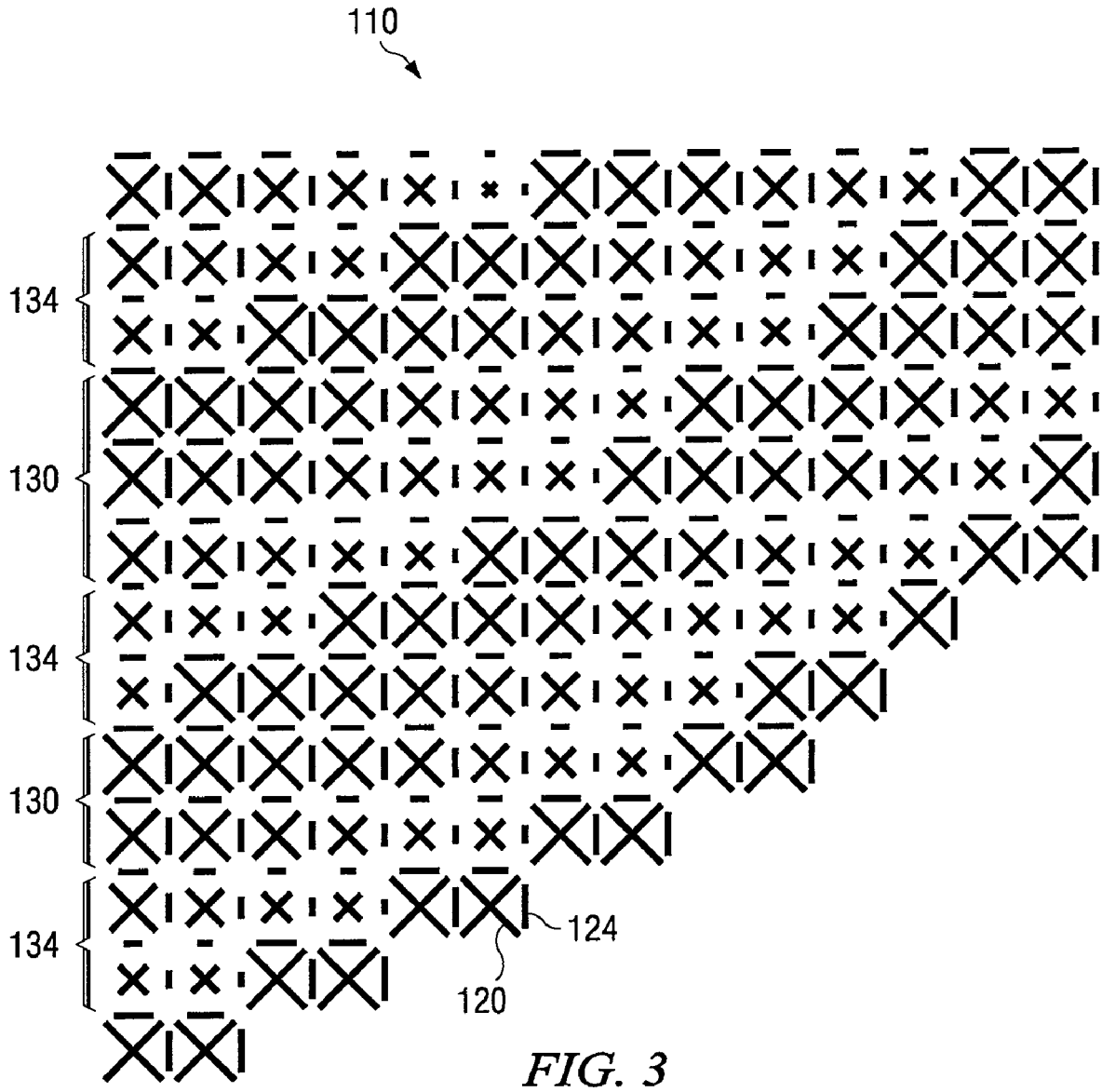
FIG. 3 illustrates an enlarged view of an example pattern that may be used with the main reflectors of FIG. 2.

FIG. 3 illustrates an enlarged view of an example pattern 110 that may be used with main reflectors 36 of FIG. 2. Pattern 110 includes interleaved crossed dipole elements 120 and linear dipole elements 124. The lengths of elements 120 and 124 control the phase of the surface reflection. Portions 130 with longer dipole elements reflect at a different phase than portions 134 with shorter dipole elements. The combination of crossed dipole elements 120 and linear dipole elements 124 may allow for a 360 degree variation in reflection phase, which corresponds to one wavelength at the design center frequency.

Modifications, additions, or omissions may be made to pattern 110 without departing from the scope of the invention. Pattern 110 may include more, fewer, or other elements. Additionally, the elements may be placed in any suitable arrangement.

Figure 4:
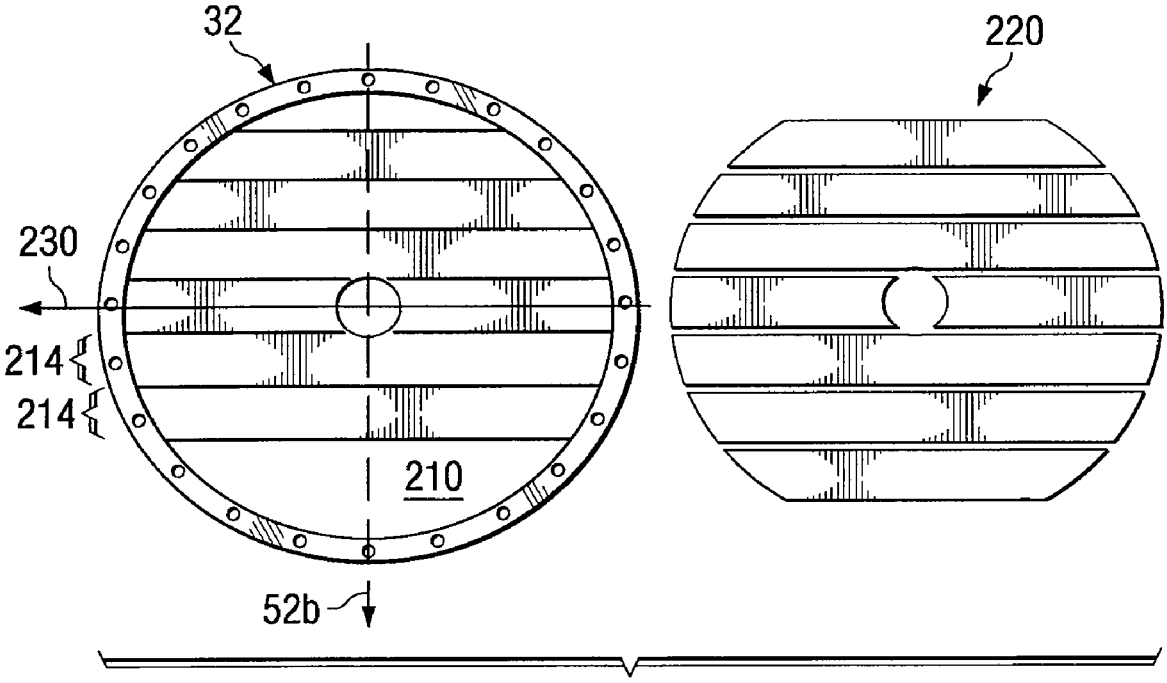
FIG. 4 illustrates an embodiment of a prism that may be used with the system of FIG. 1.

FIG. 4 illustrates an embodiment of prism 32 that may be used with system 10 of FIG. 1. Prism 32 may comprise a refractive layer 210 and an anti-reflective layer 220. Refractive layer 210 may comprise any suitable material operable to refract signals. For example, refractive layer 210 may comprise a dielectric material.

According to one embodiment, prism 32 may have a constant thickness along an axis 230 and a stepped profile of any suitable number of zone steps 214, like a Fresnel lens, along axis 52*b*. A stepped profile may have a reduced thickness at each step 214. The thickness may be reduced by, for example, approximately integer multiples of a wavelength in the dielectric at the design center frequency. Zone steps 214 may occur at uniform or non-uniform increments.

According to one embodiment, prism 32 may have an anti-reflective layer 220 that may reduce the reflection of signals from prism 32. Anti-reflective layer 220 may have a refractive index that is approximately between that of air and that of the material of refractive layer 210. Anti-reflective layer 220 may comprise a continuous coating or individual strips.

In one embodiment, prism 32 may focus signals. Prism 32 may have a thickness variation that is quadratic in radius measured from boresight axis 50. In the embodiment, the zone steps may have elliptical instead of linear contours. This may reduce the strength of sidelobes caused by the zone steps.

Modifications, additions, or omissions may be made to prism 32 without departing from the scope of the invention. The components of prism 32 may be integrated or separated.

Moreover, the operations of prism 32 may be performed by more, fewer, or other components.

Although this disclosure has been described in terms of certain embodiments, alterations and permutations of the embodiments will be apparent to those skilled in the art. Accordingly, the above description of the embodiments does not constrain this disclosure. Other changes, substitutions, and alterations are possible without departing from the spirit and scope of this disclosure, as defined by the following claims.

What is claimed is:

1. A system for steering a beam, comprising:
a main reflector having an asymmetrical pattern and operable to:
receive a signal from a subreflector; and
reflect the signal in a reflection direction, the asymmetrical pattern yielding the reflection direction different from a boresight axis;
a prism coupled to the main reflector and operable to:
refract the signal in a refraction direction; and
one or more motors coupled to at least one of the main reflector or the prism, and operable to:
adjust a relative orientation between the main reflector and the prism to change a relative orientation between the reflection direction and the refraction direction to steer a beam resulting from the signal.

2. The system of claim 1, wherein:
at least one of the main reflector or the prism is operable to rotate substantially about a boresight axis; and
the one or more motors are operable to adjust the relative orientation between the main reflector and the prism by:
rotating the at least one of the main reflector or the prism about the boresight axis.

3. The system of claim 1, wherein the main reflector has a pattern comprising:
a plurality of linear dipole elements; and
a plurality of crossed dipole elements.

4. The system of claim 1, wherein the prism comprises:
a plurality of zone steps; and
an anti-reflective layer operable to reduce reflection of the signal from the prism.

5. The system of claim 1, wherein the one or more motors comprises at least one of:
a prism motor operable to move the prism; and
a main reflector motor operable to move the main reflector.

6. The system of claim 1, wherein the one or more motors comprises:
a motor operating substantially at a periphery of the main reflector.

7. The system of claim 1, wherein the prism is operable to refract the signal in a refraction direction by:
refracting the signal a plurality of times.

8. The system of claim 1, further comprising the subreflector, the subreflector operable to:
receive the signal from an antenna feed; and
reflect the signal.

9. The system of claim 1, the main reflector further comprising a printed circuit board with a frequency selective surface (FSS) patterned in the asymmetrical pattern.

10. A method for steering a beam, comprising:
receiving at a main reflector a signal from a subreflector, the main reflector having an asymmetrical pattern;
reflecting the signal from the main reflector in a reflection direction, the asymmetrical pattern yielding the reflection direction different from a boresight axis;
refracting at a prism the signal in a refraction direction; and
adjusting by one or more motors a relative orientation between the main reflector and the prism to change a relative orientation between the reflection direction and the refraction direction to steer a beam resulting from the signal.

11. The method of claim 10, wherein:
at least one of the main reflector or the prism is operable to rotate substantially about a boresight axis; and
adjusting by the one or more motors the relative orientation between the main reflector and the prism further comprises:
rotating the at least one of the main reflector or the prism about the boresight axis.

12. The method of claim 10, wherein the main reflector has a pattern comprising:
a plurality of linear dipole elements; and
a plurality of crossed dipole elements.

13. The method of claim 10, wherein the prism comprises:
a plurality of zone steps; and
an anti-reflective layer operable to reduce reflection of the signal from the prism.

14. The method of claim 10, wherein adjusting by the one or more motors the relative orientation between the main reflector and the prism further comprises at least one of:
moving the prism using a prism motor; and
moving the main reflector using a main reflector motor.

15. The method of claim 10, wherein the one or more motors comprises:
a motor operating substantially at a periphery of the main reflector.

16. The method of claim 10, wherein refracting at a prism the signal in the refraction direction further comprises:
refracting the signal a plurality of times.

17. The method of claim 10, further comprising:
receiving at the subreflector the signal from an antenna feed; and
reflecting the signal from the subreflector.

18. The method of claim 10, the main reflector further comprising a printed circuit board with a frequency selective surface (FSS) patterned in the asymmetrical pattern.

19. A system for steering a beam, comprising:
means for receiving at a main reflector a signal from a subreflector, the main reflector having an asymmetrical pattern;
means for reflecting the signal from the main reflector in a reflection direction, the asymmetrical pattern yielding the reflection direction different from a boresight axis;
means for refracting at a prism the signal in a refraction direction; and
means for adjusting by one or more motors a relative orientation between the main reflector and the prism to change a relative orientation between the reflection direction and the refraction direction to steer a beam resulting from the signal.

20. A system for steering a beam, comprising:
a subreflector operable to:
receive a signal from an antenna feed; and
reflect the signal;
a main reflector operable to:
receive the signal from the subreflector; and
reflect the signal in a reflection direction, the main reflector having an asymmetrical pattern that yields the reflection direction different from a boresight axis, comprising:
a plurality of linear dipole elements; and
a plurality of crossed dipole elements;
a prism coupled to the main reflector and operable to:

refract the signal in a refraction direction by refracting the signal a plurality of times, at least one of the main reflector or the prism operable to rotate substantially about the boresight axis, the prism comprising:

a plurality of zone steps; and an anti-reflective layer operable to reduce reflection of the signal from the prism; and one or more motors coupled to at least one of the main reflector or the prism, and operable to:

adjust a relative orientation between the main reflector and the prism to change a relative orientation between the reflection direction and the refraction direction to steer a beam resulting from the signal; and adjust the relative orientation between the main reflector and the prism by:

rotating the at least one of the main reflector or the prism about the boresight axis, the one or more motors comprising at least one of:

a prism motor operable to move the prism; and a main reflector motor operable to move the main reflector, the one or more motors comprising:

a motor operating substantially at a periphery of the main reflector.

* * * * *